US005230503A

United States Patent [19]

Saito et al.

[11] Patent Number: 5,230,503

[45] Date of Patent: Jul. 27, 1993

[54] SHEET FEEDING APPARATUS WITH ADJUSTABLE URGING MEMBERS

[75] Inventors: Jun Saito, Kawasaki; Toshiyuki Asakawa, Sagamihara; Akira Higeta, Yokohama; Toru Kameyama, Tokyo, all of Japan

[73] Assignees: Canon Kabushiki Kaisha, Tokyo; Dai-Ichi Seiki Kogyo Co., Ltd., Ibaraki, both of Japan

[21] Appl. No.: 825,327

[22] Filed: Jan. 27, 1992

Related U.S. Application Data

[63] Continuation of Ser. No. 426,936, Oct. 26, 1989, abandoned.

[30] Foreign Application Priority Data

| | | | |
|---|---|---|---|
| Oct. 31, 1988 | [JP] | Japan | 63-275391 |
| Oct. 31, 1988 | [JP] | Japan | 63-275392 |
| Jul. 11, 1989 | [JP] | Japan | 1-178250 |
| Jul. 13, 1989 | [JP] | Japan | 1-181563 |
| Sep. 13, 1989 | [JP] | Japan | 1-238976 |

[51] Int. Cl.[5] ..... B65H 3/52; B65H 1/10

[52] U.S. Cl. ..... 271/121; 271/126; 271/160

[58] Field of Search ..... 271/126, 165, 121, 160

[56] References Cited

U.S. PATENT DOCUMENTS

| | | | |
|---|---|---|---|
| 1,919,238 | 7/1933 | McCarthy . | |
| 3,869,116 | 3/1975 | Kloeker | 271/126 X |
| 3,963,339 | 6/1976 | Taylor et al. . | |
| 4,027,871 | 6/1977 | Niemeyer et al. | 271/165 X |
| 4,364,551 | 12/1982 | Rujishauser | 271/121 |
| 4,418,904 | 12/1983 | Fujimoto | 271/165 X |
| 4,458,890 | 7/1984 | Kawazu | 271/37 |
| 4,606,535 | 8/1986 | Larson | 271/165 X |
| 4,957,285 | 9/1990 | Yamada | 271/126 X |

FOREIGN PATENT DOCUMENTS

| | | | |
|---|---|---|---|
| 0023603 | 2/1981 | European Pat. Off. . | |
| 156140 | 12/1980 | Japan | 271/126 |
| 43741 | 3/1984 | Japan | 271/165 |
| 211221 | 9/1987 | Japan | 271/126 |
| 71033 | 3/1988 | Japan | 271/165 |
| 181628 | 7/1989 | Japan | 271/126 |
| 321217 | 12/1989 | Japan | 271/126 |
| 8607339 | 12/1986 | PCT Int'l Appl. . | |
| 827057 | 2/1960 | United Kingdom . | |

OTHER PUBLICATIONS

Seldin, "Document Handler", 1-1976, Xerox Disclosure Journal, vol. 1, No. 1, p. 91.

*Primary Examiner*—Robert P. Olszewski
*Assistant Examiner*—Boris Milef
*Attorney, Agent, or Firm*—Fitzpatrick, Cella, Harper & Scinto

[57] ABSTRACT

This invention relates to a sheet feeding apparatus with a support for stacking sheets; feeding roller for feeding out sheets stacked on the support; a plurality of urging members for urging the stacked sheets against the feeding roller; and a stopper for releasing at least one of the plurality of urging members from urging against the stack of sheets whenever the amount of sheets is less than a predetermined level.

13 Claims, 16 Drawing Sheets

SHEET FEEDING APPARATUS WITH ADJUSTABLE URGING MEMBERS

This application is a continuation of application Ser. No. 07/426,936, filed Oct. 26, 1989, now abandoned.

BACKGROUND OF THE INVENTION

1. Field of the Invention

This invention relates to a sheet feeding apparatus (sheet feeder) used for an image-forming apparatus such as a copier or a laser beam printer. More particularly, the invention concerns a sheet feeder which can feed thick sheets such as envelopes one by one.

2. Related Background Art

U.S. Pat. No. 1,919,238 discloses a sheet feeder, which feeds sheets with the lowermost sheet in a sheet stack in contact with a feed roller.

Also, U.S. Pat. No. 3,963,339 discloses a sheet feeder, which feeds sheets with the lowermost sheet of a sheet stack in contact with a conveyor belt, and in which the sheet stack is urged against the conveyor belt by a lever.

Further, it is conceivable to put a weight on the sheet stack so as to increase the sheet-feeding force in cases where the lowermost sheet of sheet stack is fed by the feed roller.

However, since such a weight in such sheet feeder is constant, when a large number of sheets are stacked, the urging force is absorbed by an air cushioning effect between adjacent sheets, the effect being pronounced particularly between adjacent envelopes to be fed. In this case, the urging force is not sufficiently transmitted to the lowermost sheet, and defective sheet-feeding is liable to result from insufficient sheet-feeding force. Further, when sheets in the stack are reduced, double feeding is liable occur due to excessive urging force.

SUMMARY OF THE INVENTION

The present invention is intended in the light of the above, and its object is to preclude the drawbacks inherent in the prior art.

According to the invention, there is provided a sheet feeder, which comprises a support means for stacking a plurality of sheets, a feed roller for feeding sheets stacked on the support means one by one from the lowermost one and urging means for urging the stacked sheets against the feed roller in contact with the uppermost sheet in the stack. In this sheet feeder, the urging means is constituted by a plurality of urging members, these urging members being coupled to one another such that they can be displaced vertically by a predetermined distance. The number of urging members riding on the sheet stack is changed according to the number of sheets stacked on the stacking means, thus changing the urging force of the urging means at least in two stages.

With the above construction, the sheets stacked on the stacking means are urged against the feed roller by the urging means to be fed out by the feed roller one by one from the lowermost one. The urging means changes its urging force at least in two stages by changing the number of urging members riding on the sheet stack according to the number of sheets stacked on the stacking means.

When the urging force applied to the sheet stack is reduced stepwise as above, and the number of remaining sheets in the stack becomes very small, the urging force may be excessive, possibly resulting in double or simultaneous feeding of sheets.

Accordingly, according to the invention there is also provided urging means for a sheet feeder, which can provide a continuously reducing urging force to the sheet stack on the stack support when the stacked sheets are reduced to a certain number.

According to another aspect of the invention, there is further provided urging means for a sheet feeder, which comprises feeding means for feeding out stacked sheets one by one from the lowermost one, and urging means for urging the stacked sheets against the feeding means, the urging means including a plurality of urging elements consisting of auxiliary urging elements which cease to provide urging action according to reduction of stacked sheets and main urging elements which provide continual urging action, the number of operative urging elements being thereby reduced stepwise according to the reduction of stacked sheets. A biasing member is provided between an auxiliary urging element and a main urging element for continuously reducing the urging force of the main urging elements.

With this construction, the stacked sheets are urged against the feeding means (i.e., a feed roller) by the urging means and are fed out one by one from the lowermost one. When there are a large number of stacked sheets, the sheets are urged by both the auxiliary and main urging elements of the urging means. When the stacked sheets are reduced to a predetermined number of sheets, the auxiliary urging elements cease to provide urging action, and only the main urging elements continually provide urging action. The main urging elements are biased by biasing means such as to continuously reducing urging force with reduction of stacked sheets, thus preventing double feeding of sheets.

DETAILED DESCRIPTION OF THE PREFERRED EMBODIMENT

Now, an embodiment of the invention will be described with reference to the accompanying drawings.

Figure 1:
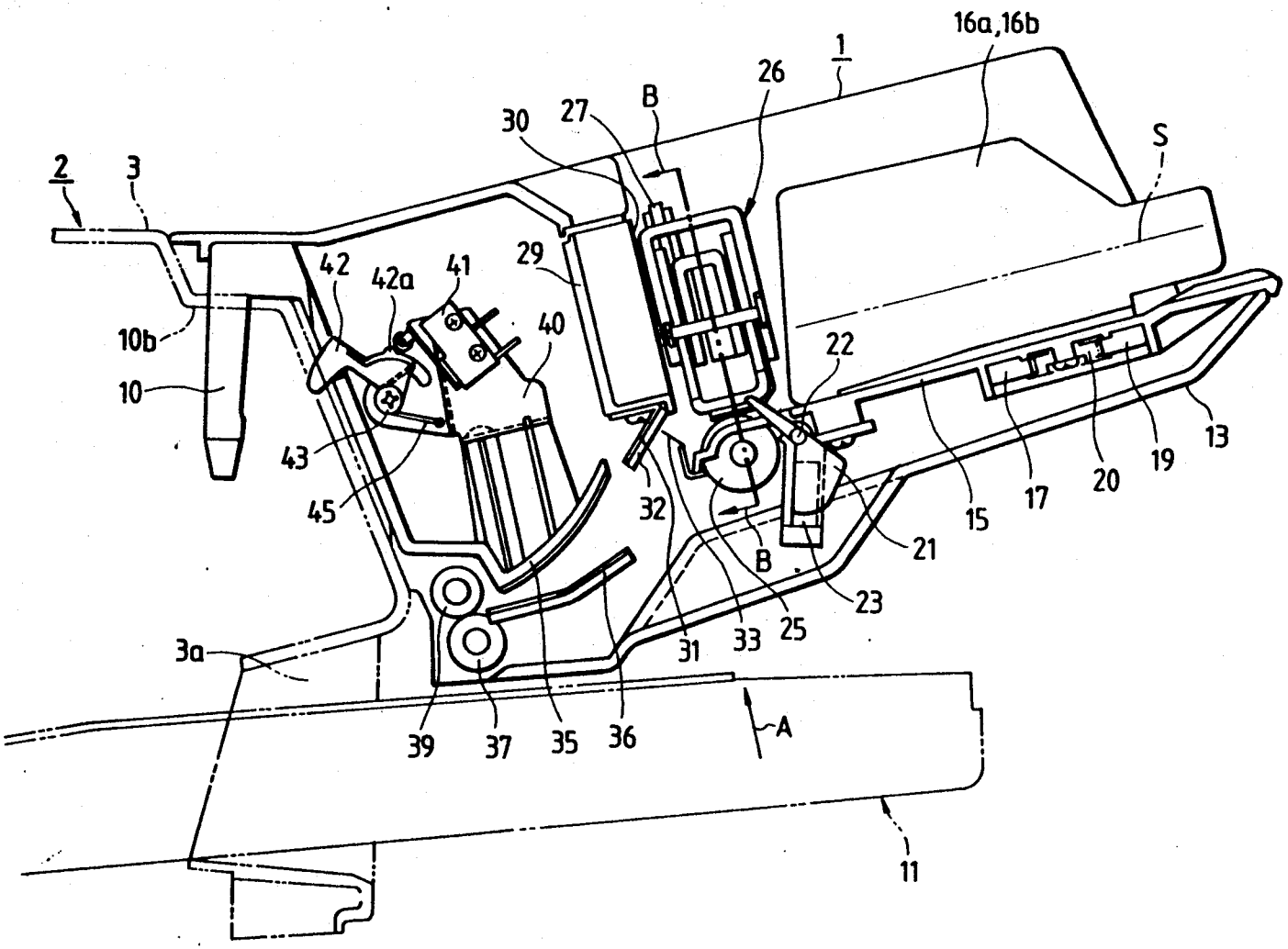
FIG. 1 is a sectional view showing an embodiment of the invention.
Figure 2:
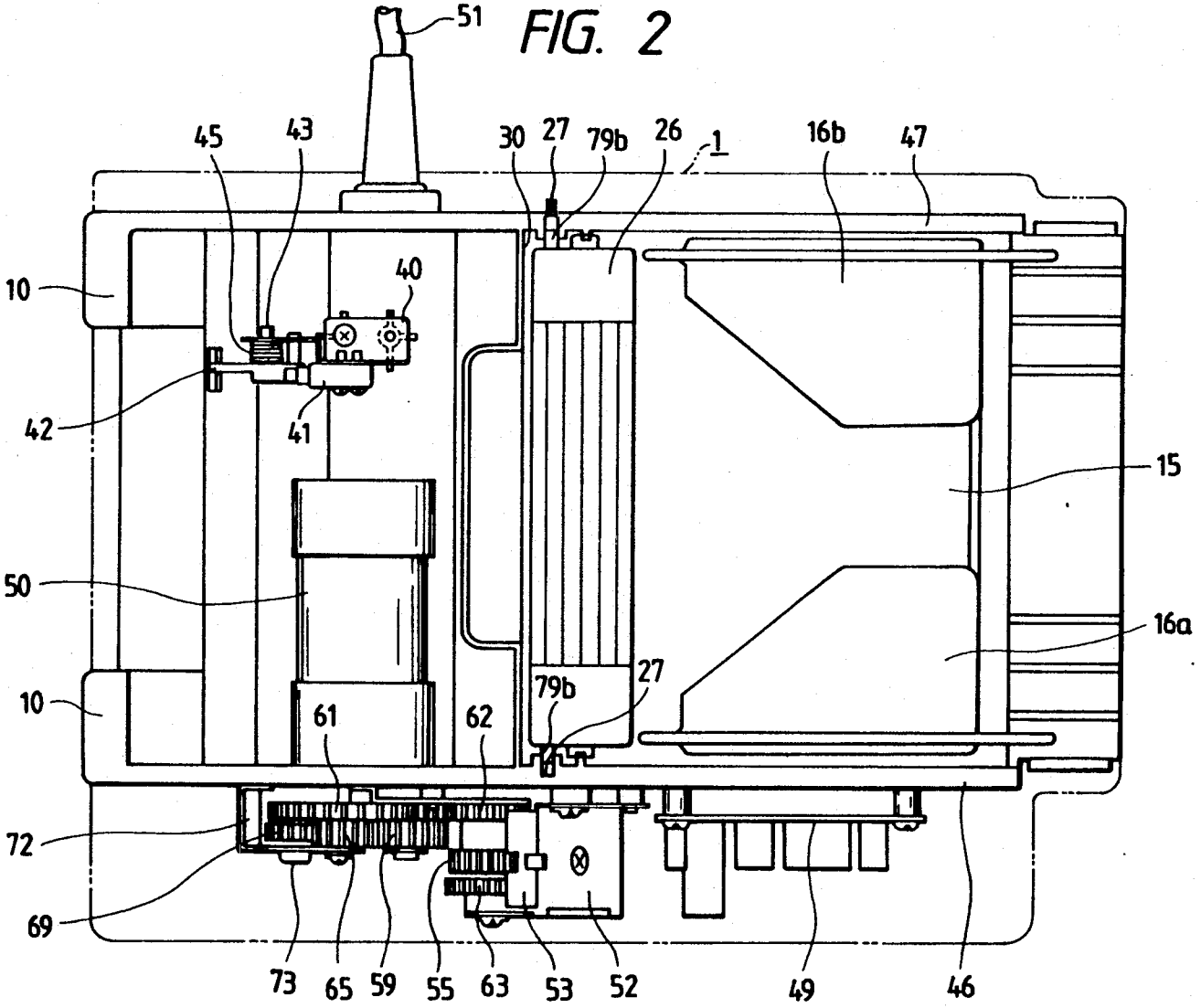
FIG. 2 is a plan view showing the same embodiment.
Figure 3:
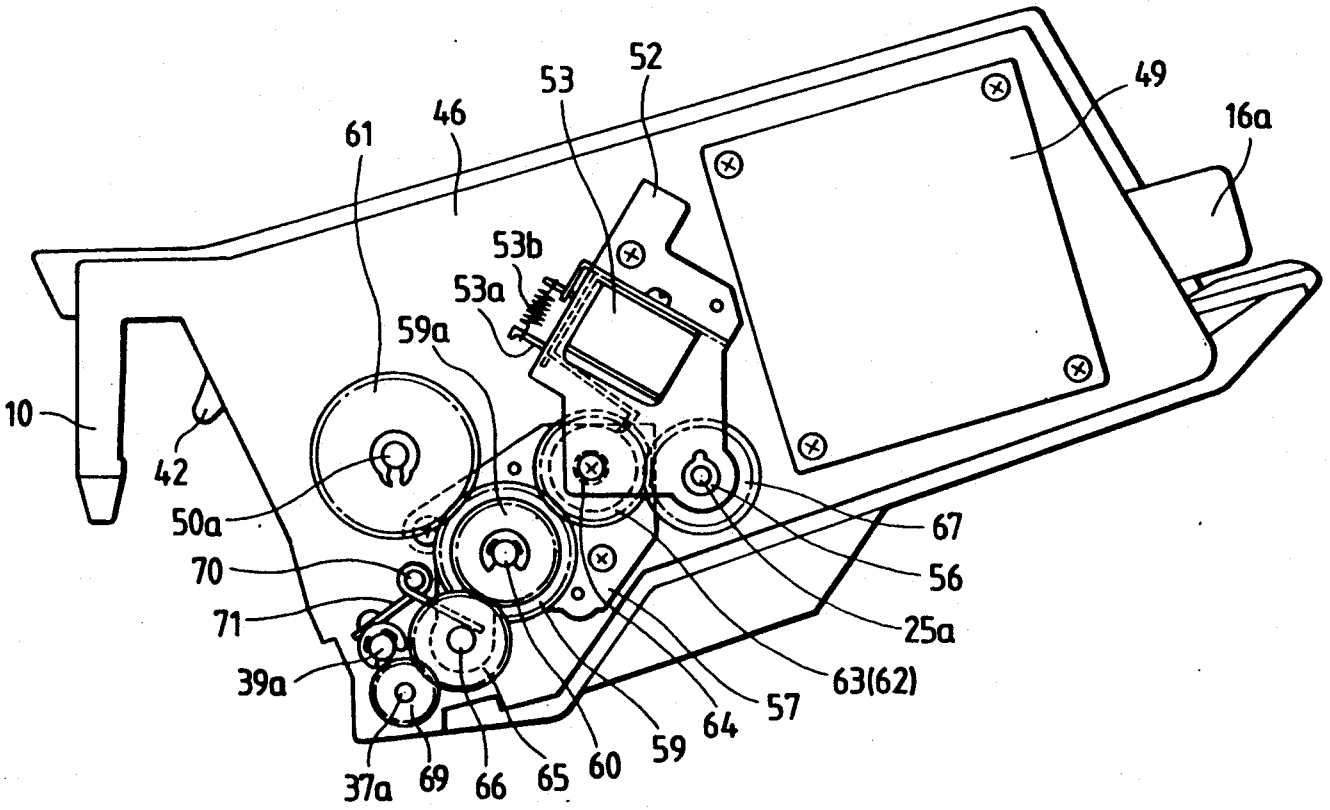
FIG. 3 is a sectional view showing a driving system of the same embodiment.

FIG. 1 is a sectional view best illustrating the features of the embodiment, FIG. 2 is a plan view showing the embodiment, and FIG. 3 is a side view showing a driving system of the embodiment.

Referring to these Figures, there is shown a sheet feeder which is generally designated by reference numeral 1. Sheet feeder 1 has a pair of positioning members 10 provided at its front end (i.e., left end in FIG. 1). It can be mounted in or dismounted from laser beam printer 2 by inserting or removing positioning members 10 into or out of holes 10*b* provided in an upper portion of housing 3 of printer 2. Beneath sheet feeder 1, cassette 11 can be mounted in and dismounted from laser beam printer 2. Ordinary sheets are stacked in cassette 11. A wall of laser beam printer 2 above cassette 11 has a manual feed opening 3*a*, through which a sheet can be fed manually.

Housing 13 of sheet feeder 1 has stack support 15 for stacking sheets S thereon. Stack support 15 has restricting members 16*a* and 16*b* for restricting stacked sheets S against movement in the width directions. Restricting members 16*a* and 16*b*, have respective slidable racks 17 and 19 extend in the width direction of stack support 15. Racks 17 and 19 are in mesh with pinion 20 rotatably mounted on the back surface of stack support 15. Thus, racks 17 and 19 with respective integral restricting members 16*a* and 16*b* are movable in the width directions in an interlocked relation to each other.

Detecting lever 21 is pivotally mounted by pin 22 on stack support 15 for detecting the presence or absence of sheets S. A lower end portion of lever 21 can be advanced into and retreated from and on-off operate photointerpreter 23 provided on the back surface of stack support 15. When stack support 15 gets out of sheet S, an upper end portion of detecting lever 21 is turned upwardly with respect to stack support 15, thus indicating the absence of sheet S.

After photointerpreter 23 in the sheet-feeding direction, feed roller 25 is rotatably mounted for feeding sheets stacked on stack support 15 one by one from the lowermost one. Above feed roller 25, weight 26 is provided for vertical displacement with its opposite end ears 79*b* (see FIG. 2) loosely received in pair guide grooves 27 (see FIG. 2) provided in housing 13. Weight 26 serves to urge sheets S against feed roller 25 in a manner as described later. Sheets S are envelopes or like thick sheets.

Support member 29 (see FIG. 1) secured in position after weight 26 in the sheet-feeding direction supports end-restricting member 30 for restricting and aligning front ends of sheets S stacked on stack support 15. The lower end of end-restricting member 30 is spaced apart from the front end of stack support 15 by a predetermined distance to permit feeding of sheets S through this space. Separating pad support 31 secured to a lower portion of support member 29 is provided with separating plate (separating pad) 32 made of rubber or like highly frictional material. Separating pad 32 has a suitable inclination angle with respect to the sheet-feeding direction, in which each sheet S is fed out from stack support 15. Elastic member 33 having flexibility is secured in position such that it faces separating pad 32 for urging sheets S fed out from feed roller 25 against separating pad 32 and thus preventing double feeding of sheets S.

Pair transport guides 35 and 36 for guiding sheet S and transport roller 37 are disposed after separating pad 32 in the sheet-feeding direction. Pinch roller 39 spring biased by a spring (not shown) is urged against transport roller 37. Bracket 40 secured in position above transport guides 35 and 36 has microswitch 41 secured to it.

Bracket 40 is also pivoted by set screw 43 detecting lever 42 for detecting the set state of sheet feeder 1 with respect to laser beam printer 2. Detecting lever 42 is biased in the counterclockwise direction in FIG. 1 by torsion spring 45 having the opposite ends secured to bracket 40 and detecting lever 42, respectively. When setting sheet feeder 1 in position, detecting lever 42 is urged by housing 3 and rotated in the clockwise direction in FIG. 1. As a result, projection 42*a* of detecting lever 42 urges an operating lever of microswitch 41 and turns on the same, thus detecting the setting of sheet feeder 1.

Now, a driving system of the sheet feeder having the above construction will be described with reference to FIGS. 2 and 3.

Referring to the Figures, sheet feeder 1 has a pair of side plates 46 and 47,. which are formed with guide grooves 27 noted above for guiding weight 26. Board 49 is secured by a plurality of supports to the outer surface of side plate 46. It undertakes control of drive motor 50 secured to its inner surface and also transfer of signals between laser beam printer 20 and sheet feeder 1. To other side plate 47 is connected one end of cable 51, which connects sheet feeder 1 and laser beam printer 2 to each other.

Solenoid 53 for spring clutch control to be described later is secured to bracket 52 which is in turn secured to side plate 46. Bracket 52 also serves as a grounding member to ground metal bearing 56 supporting transport roller 37 noted above.

As shown in FIG. 3, relay gear 59 integral with relay gear 49*a* is rotatably supported by shaft 60 in support 57, which is secured in position at a suitable spacing from side plate 46. Relay gear 59 is in mesh with gear 61 secured to output shaft 50*a* of drive motor 50. Relay gears 62 and 63 meshing with relay gear 59 are supported by shaft 64 in support 57, and also relay gear 65 meshing with relay gear 59*a* is supported by shaft 66 in support 57. Support 57 is electrically connected via shaft 64 to bracket 52. Thus by grounding bracket 52 shaft 25*a* of feed roller 25 and shaft 37*a* of transport roller 37 are also grounded.

Relay gear 62 meshing with relay gear 59 is coupled to gear 63 via clutch unit 55 having a well-known spring clutch. Clutch unit 55 is on-off operated to on-off control drive power transmission of gears 62 and 63 under on-off control of solenoid 53.

Lever 53*a* for locking clutch unit 55 is pivoted to bracket 52. It is coupled at one end to spring 53*b*, which is provided on bracket 52, and thus it is spring-biased in the clockwise direction. Solenoid 53 serves to attract and release lever 53*a*. Gear 63 is in mesh with gear 67 secured to shaft 25*a* of feed roller 25 (see FIG. 1). Relay gear 65 is in mesh with gear 69 mounted on shaft 37*a* of feed roller 37. A one-way clutch (not shown) is provided between shaft 37*a* and gear 69. When gear 69 is rotated in the counterclockwise direction in FIG. 3, shaft 37*a* is rotated in the same direction, while it idles when gear 69 is rotated in the clockwise direction.

Torsion spring 71 is mounted on dowel 70 secured to side plate 46 and has its opposite ends attached to shaft 39*a* of pinch roller 39 and shaft 66, respectively. Pinch roller 39 is urged against transport roller 37 by the spring force of torsion spring 71. In FIG. 2, reference numeral 72 designates a connection member for electrically connecting transport roller 37 via metal bearing 73 supporting roller 37. Connecting member 72 has a stem portion secured to side plate 46 and its free end bolted to shaft 66, and it also serves as cover of gear 69.

In the above construction, when drive motor 50 is operated by a sheet-feeding signal from housing 3 of printer 2, transport roller 37 starts rotation via the gear train noted above. When predetermined-period T1 of time has been passed from the instant of generation of the sheet-feeding signal, solenoid 53 is turned on to cause rotation of feed roller 25, thus causing start of feeding of sheets S such as envelopes.

Figure 4:
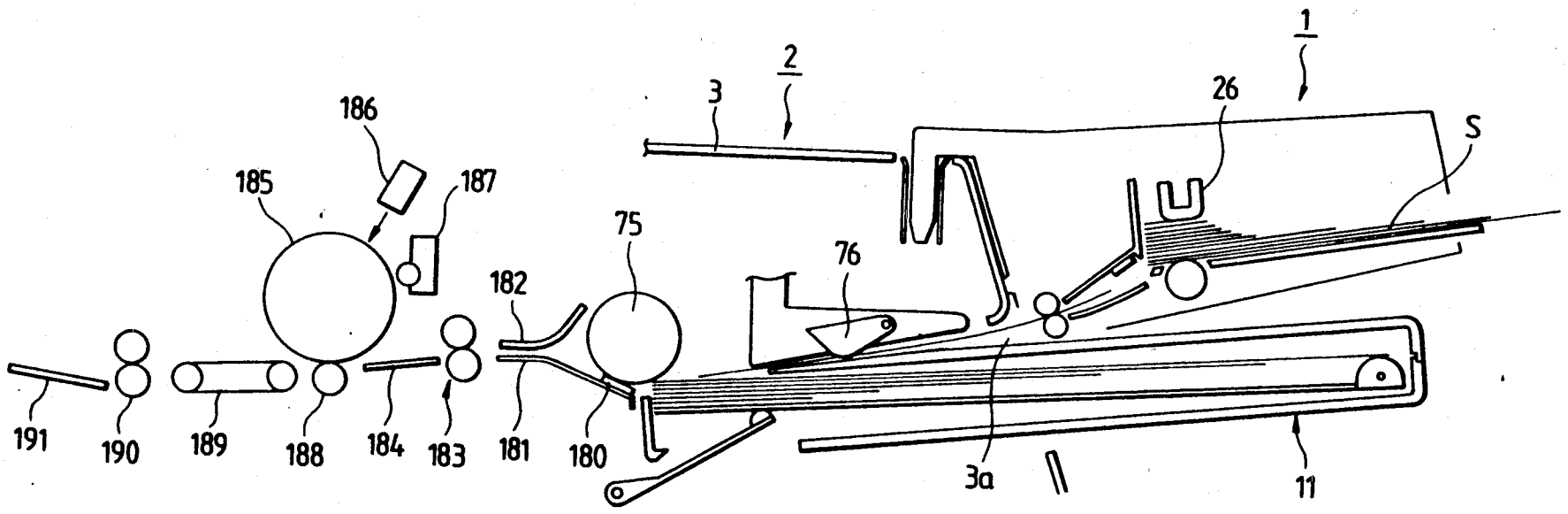
FIG. 4 is a sectional view showing an image forming apparatus.

After the lapse of predetermined period T2 of time, solenoid 53 is turned off to cut drive power transmission to feed roller 25. At this time, the leading end of sheet S being fed has reached guide while the trailing end of the sheet is on feed roller 25. Thus, the sheet is fed by the guide while feed roller 25 is rotated by the action of the one-way clutch. Sheet S fed out from sheet feeder 1 is fed by feed roller 75 in laser beam printer 2 as shown in FIG. 4 into housing 3. Sheet S fed manually through manual feed opening 3*a* of laser beam printer 2 is detected by paper sensor 76 shown in FIG. 4 to be fed by feed roller 75 into housing 3 of laser beam printer 2 for printing and then discharging.

Laser beam printer 2, as shown in FIG. 4 has feed roller 75 for feeding out sheets S accommodated in cassette 11 and separating pad 180, which is urged by a spring (not shown) against feed roller 75 for blocking second and subsequent sheets S to separate the first fed sheet. Reference numerals 181 and 182 designate transport guides. The leading end of a sheet fed out from the stationary state is brought into contact with a nip of pair registration rollers 183 for skew feeding before being fed with a timing synchronized to an image formed on photosensitive drum 185 to be described later.

Reference numeral 110 designates an image-forming unit, 185 a photosensitive drum, 186 a scanner for scanning photosensitive drum 185 with a laser beam for forming a latent image, 187 a developing unit for developing the latent image on the photosensitive drum to a tonor image, and 188 a transfer roller for transferring the tonor image formed on photosensitive drum 185 onto sheet. Reference numeral 190 designates a fixing unit for fixing the transferred tonor image on the sheet, and 191 a tray for stacking sheets discharged after the fixing operation. Reference numeral 184 designates a guide for guiding sheet from registration roller pair 183 to photosensitive drum 185, and 189 a torque conveyor for transporting the sheet from photosensitive drum 185 to fixing roller 190.

Figure 5:
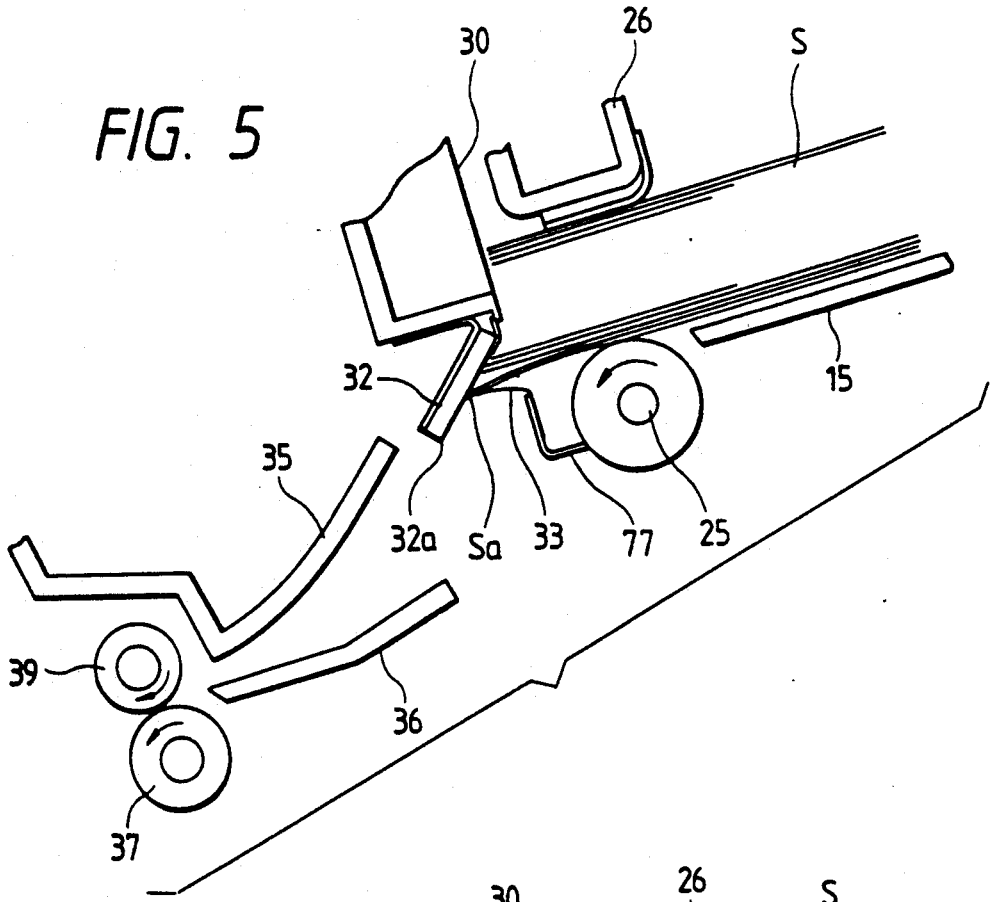
FIGS. 5 and 6 are views for explaining a sheet-feeding operation.
Figure 6:
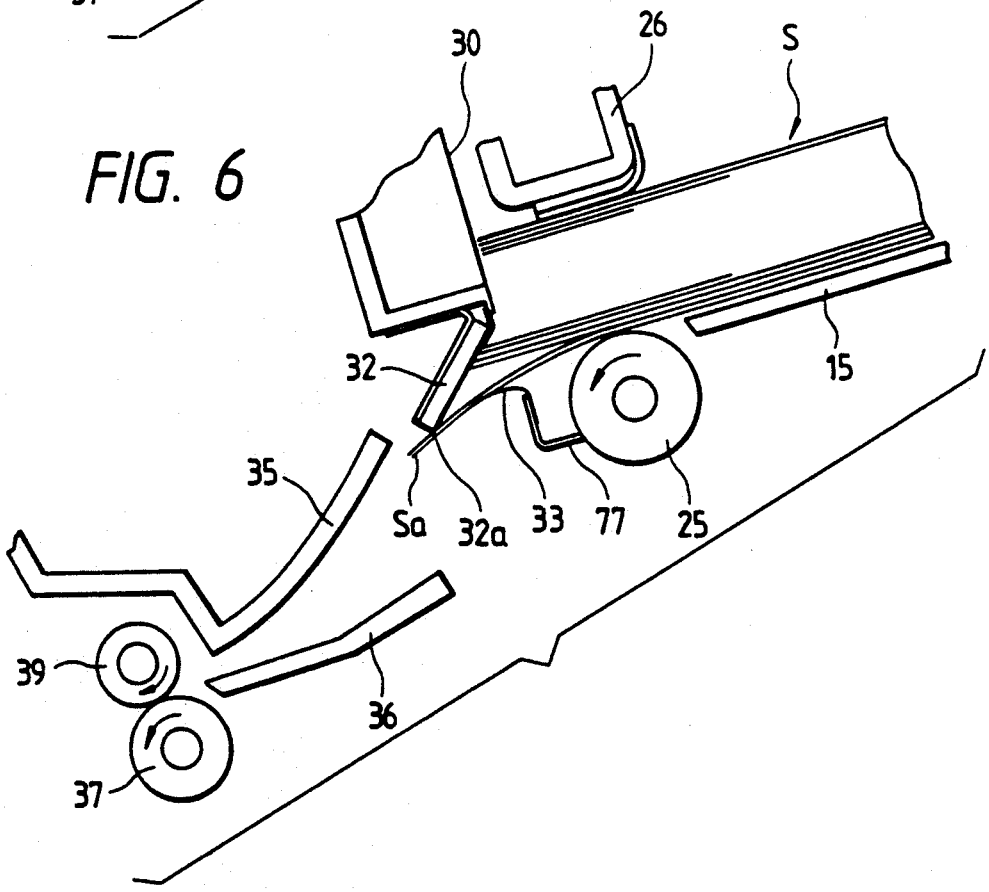

The operation of separating and feeding out each sheet will now be described with reference to FIGS. 5 and 6.

Sheets S stacked on stack support 15 with their leading ends aligned in contact with end-restricting member 30 are fed out one by one from the lowermost one Sa with an urging force provided by weight 26 and rotation of feed roller 25 in the direction of arrow. At this time, subsequent sheets Sb, Sc, . . . come out with sheet Sa due to frictional force between adjacent sheets. However, since their leading ends are urgedly retained by separating pad 32, which has a high coefficient of friction. Consequently, only sheet Sa which directly receives the feeding force of feed roller 25 is advanced by surpassing the frictional resistance offered by separating pad 32, and it thus fed out by clearing end 32*a* of separating pad 32.

Elastic member 33 is a thin sheet having flexibility, with its stem portion secured to support 77. When sheet Sa is fed to elastic member 33, the free end thereof is flexed toward the sheet-feeding direction, and the reaction force at this time has an effect of raising sheets Sa, Sb, Sc, . . . toward upper separating pad 32, thus helping the separation of the sheet. After clearing free end 32*a* of separating pad 32, sheet Sa is transported by being guided by transport guides 35 and 36 to enter between transport roller 37 and pinch roller 39. The sequence of operations described above takes place for succeeding sheets Sb, Sc, ... for separation thereof.

Weight 26 will now be described in detail with reference to FIGS. 7 to 11.

Figure 7:
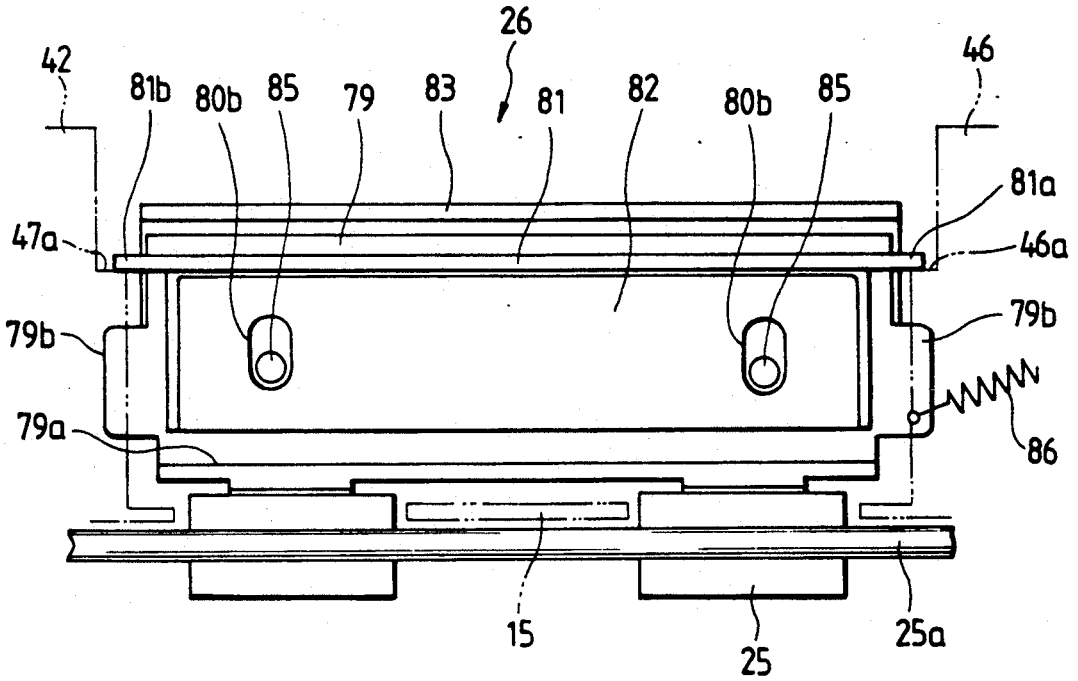
FIGS. 7 to 10 are views for explaining the function of weight.
Figure 8:
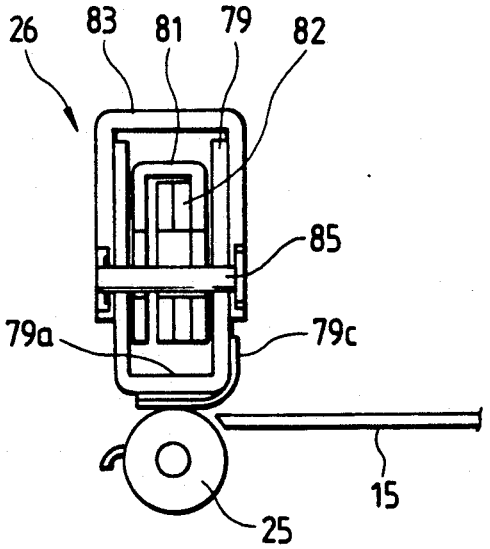
Figure 9:
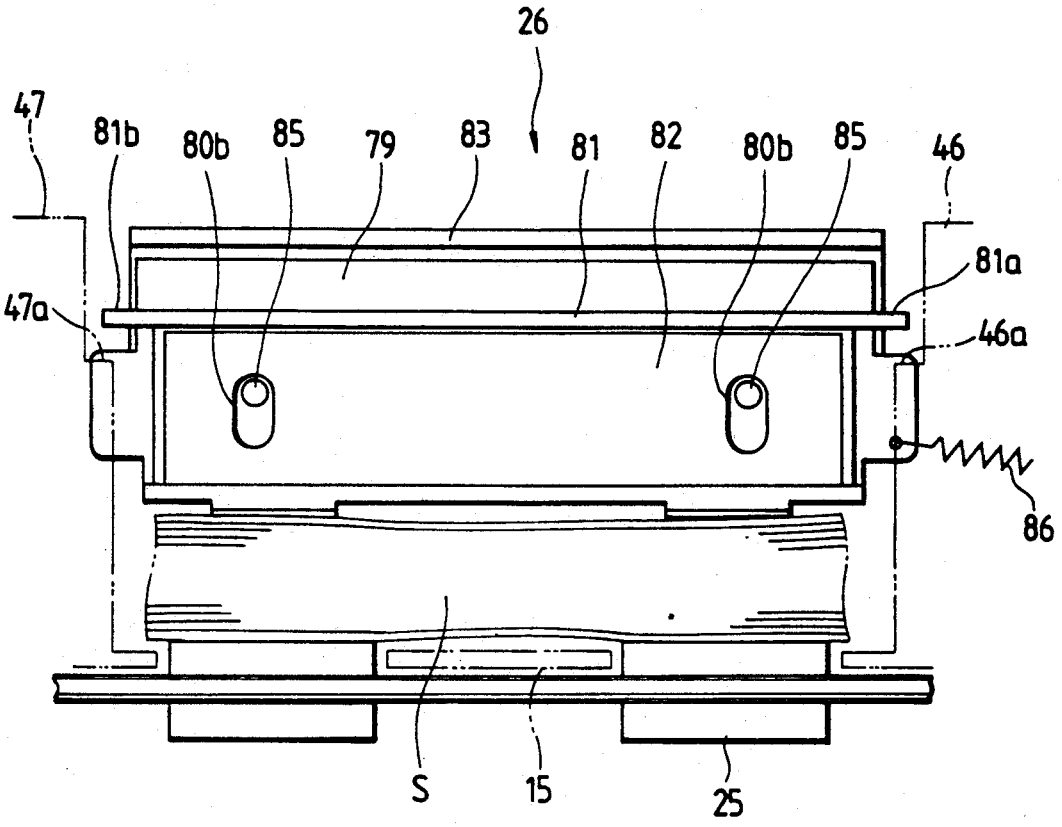
Figure 10:
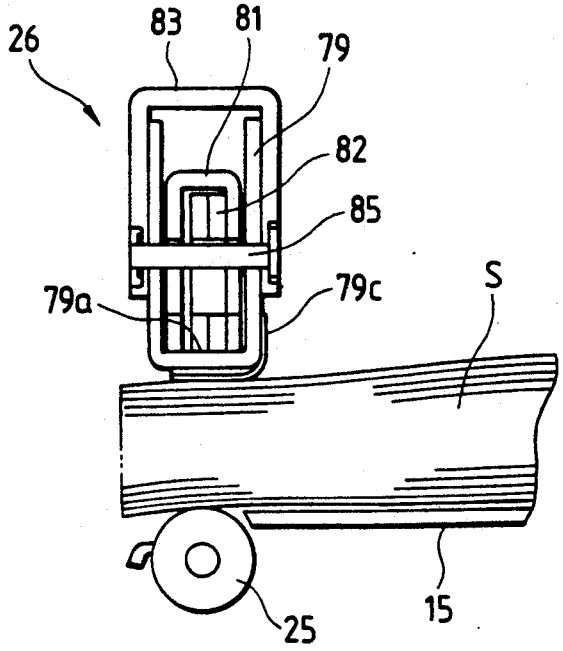
Figure 11:
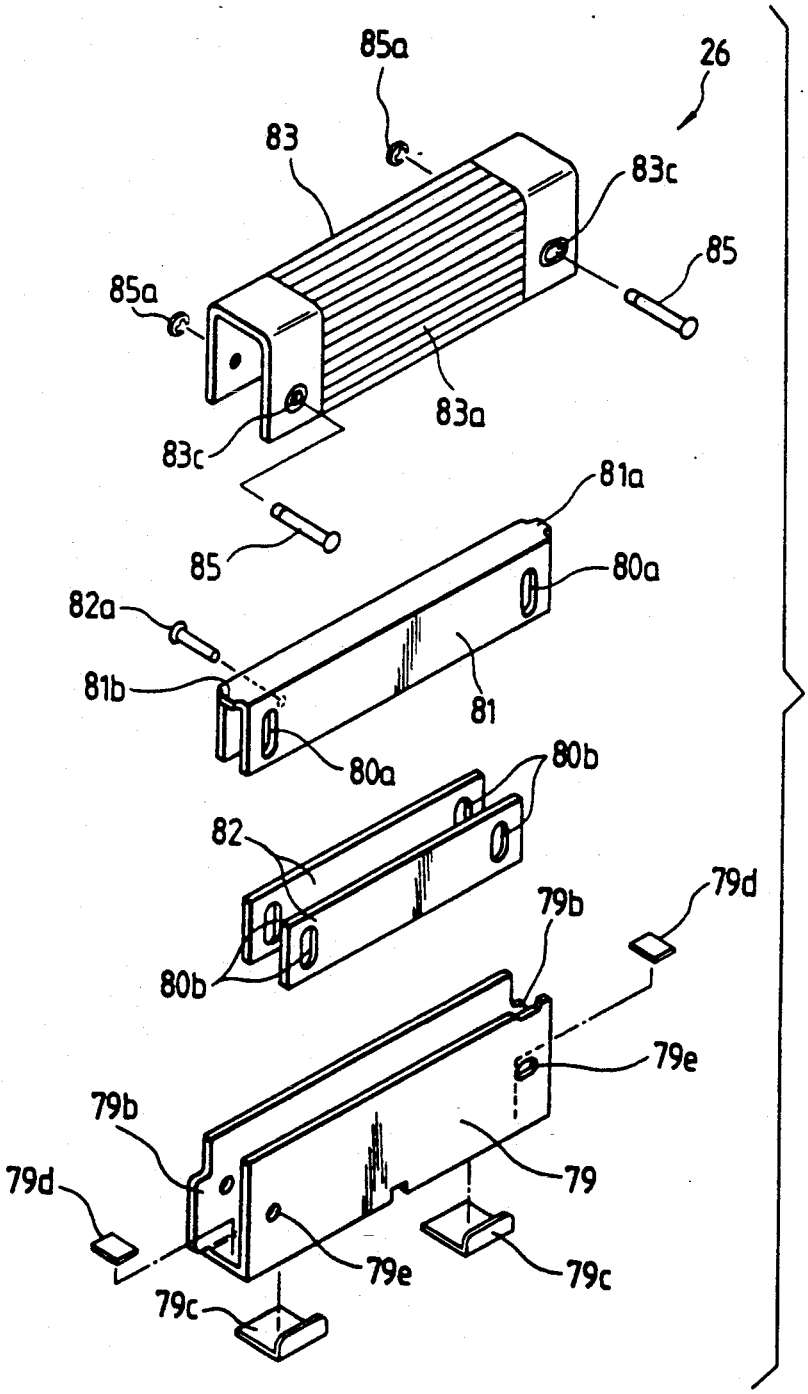
FIG. 11 is an exploded perspective view showing a weight construction.

FIGS. 7 and 9 show, in a section taken along line B—B in FIG. 1, a state when there is no sheet on stack support 15 and a state when there are at least a certain number of sheets on the support, respectively. FIGS. 8 and 10 are sectional views corresponding to FIGS. 7 and 9, respectively.

Referring to these Figures, weight 26 includes outer weight 79 and inner weight 81. Outer weight 79 has a channel-like sectional profile open upwardly. Inner weight 81 is accommodated in outer weight 79 and has a channel-like sectional profile open downwardly. A plurality of (i.e., two in FIG. 8) auxiliary weights 82 are accommodated in and secured by bolts 82*a* to inner weight 81. These auxiliary weights 82 are provided for controlling the weight of inner weight 81. Weight cover 83 is fitted on outer weight 79 to permit weight 26 to be held with a hand of the operator.

The outer surface of weight cover 83 is formed with grooves 83*a*. Pair pins 85, which penetrate weight cover 83 and outer weight 79 and are retained against detachment by E-rings 85*a*, also penetrate vertically elongate slots 80*a* and 80*b* formed in inner weight 81 and auxiliary weights 82. With this arrangement, inner weight 81 is capable of being displaced vertically with respect to outer weight 79 by the distance, by which pins 85 can be displaced along slots 80*a* and 80*b*. Inner weight 81 has opposite end projections 81*a* and 81*b*, and stoppers 46*a* and 47*a* formed as shoulders in side plates 46 and 47 of housing 13 are found below and face respective projections 81*a* and 81*b*. Grounding spring 86 has one end connected to outer weight 79 for grounding the same. Its other end is secured to a grounding plate (not shown). Outer weight 79 has projections 79*b* received in guide grooves 27 on the printer side. Friction member 79*c* is applied to the outer surface of a bottom portion to vertical front side portion in the sheet-feeding direction of outer weight 79. It is made of a material having substantially the same coefficient of friction as that of sheet. Further, buffering members 79*d* are applied to opposite end portions of the inner surface of the bottom portion of outer weight 79.

When a certain number of sheets S are stacked on stack support 15, as shown in FIGS. 9 and 10, projections 81*a* and 81*b* are found above stoppers 46*a* and 47*a*. In this state, inner weight 81 is supported by bottom portion 79*a* of outer weight 79. Thus, the total weight of weight 26 mainly comprising outer weight 79, inner weight 81 and weight cover 83 is acting as urging force on sheets S. As the number of sheets S on stack support 15 is reduced due to one-by-one feeding, weight 26 is progressively lowered, and eventually projections 81*a* and 81*b* of inner weight 81 come to engage with stoppers 46*a* and 46*b*.

As the number of stacked sheets S is further reduced, inner weight 81 is separated from bottom 79*a* of outer weight 26, and only the weight the other part of weight 26 than inner weight 81 and auxiliary weights 82 is applied to sheets S. This operation is graphically shown as in FIG. 12. As is shown, the urging force is constant from the instant when there is a full stack of sheets S until projections 81*a* and 81*b* engage with stoppers 46*a* and 47*a*. This operation is represented by a plot segment from point a to point b. When projections 81*a* and 81*b* come to engagement with stoppers 46*a* and 47*a*, the urging force is reduced from point b to point c. Subsequently, the urging force is fixed until the number of stacked sheets becomes zero as represented by a plot segment from point c to point e.

The urging force is varied step-wise as shown above because the optimum urging force applied to sheets S is high when there are many stacked sheets S and low when there are a small number of sheets S. Thus, when there are many sheets stacked on the sheet-stacking means, a sufficient urging force can be ensured to provide a stable sheet-feeding force. Also, when the number of stacked sheets is reduced, excessive urging force is prevented to prevent double feeding. If the urging force applied to the stack of sheets S is inadequate, defective feeding or double feeding may occur.

In the above embodiment the urging force applied to the stack of sheets S is varied stepwise. However, the urging force is still too high when remaining stacked sheets S are reduced to a very small number, and therefore double feeding of sheets S may occur.

In the following, an embodiment which can solve the above problem will be described. Parts like those in the preceding embodiment are designated by like reference numerals and symbols while omitting their description.

Figure 13:
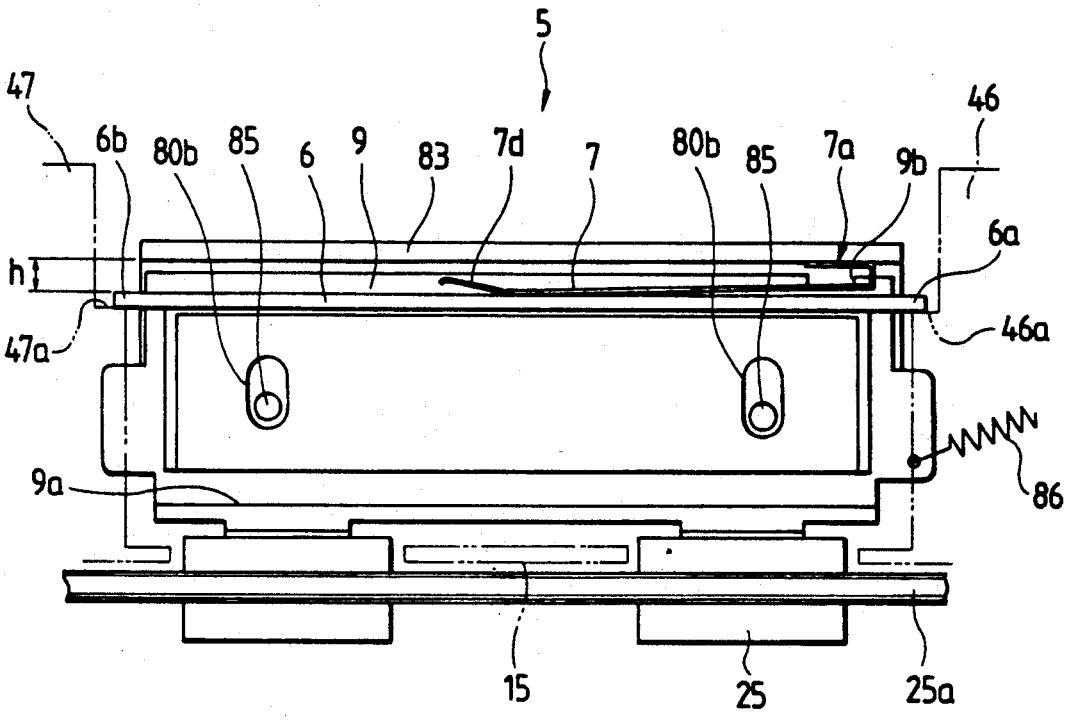
FIGS. 13 to 19 are views for explaining different examples of weight.
Figure 14:
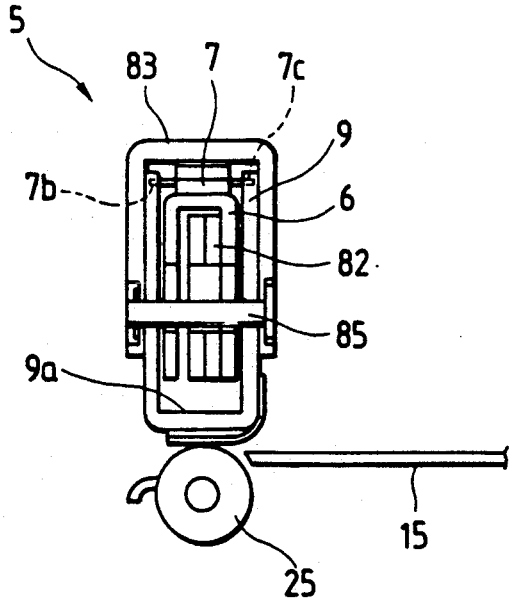
Figure 15:
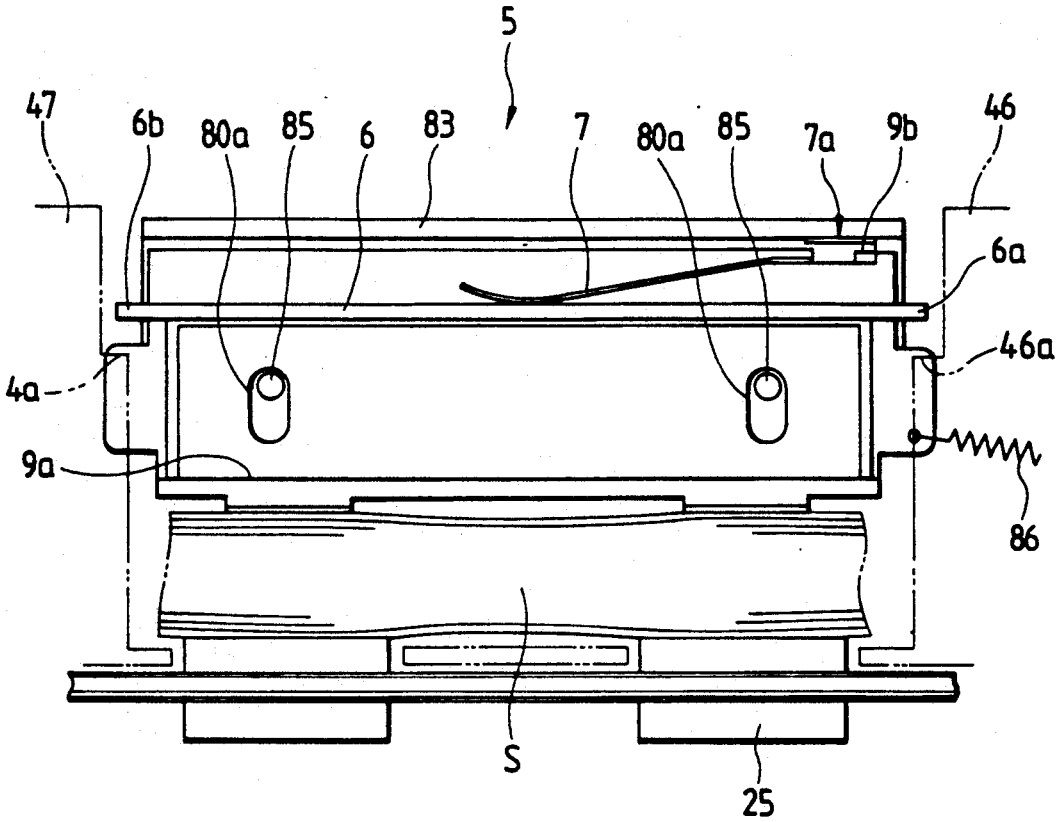
Figure 16:
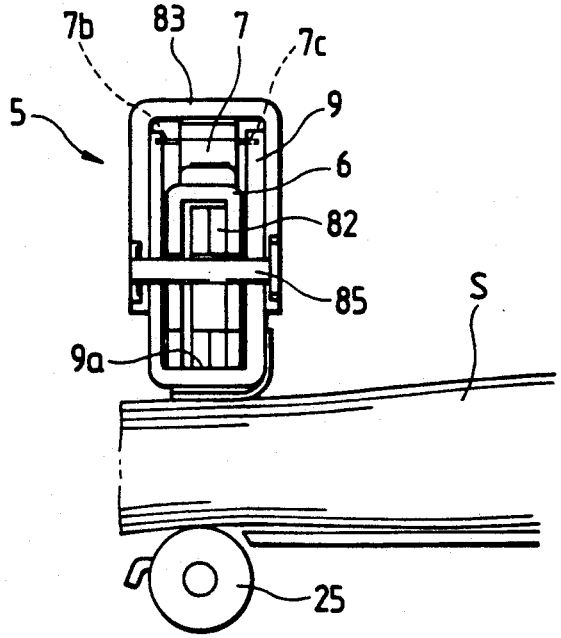
Figure 17:
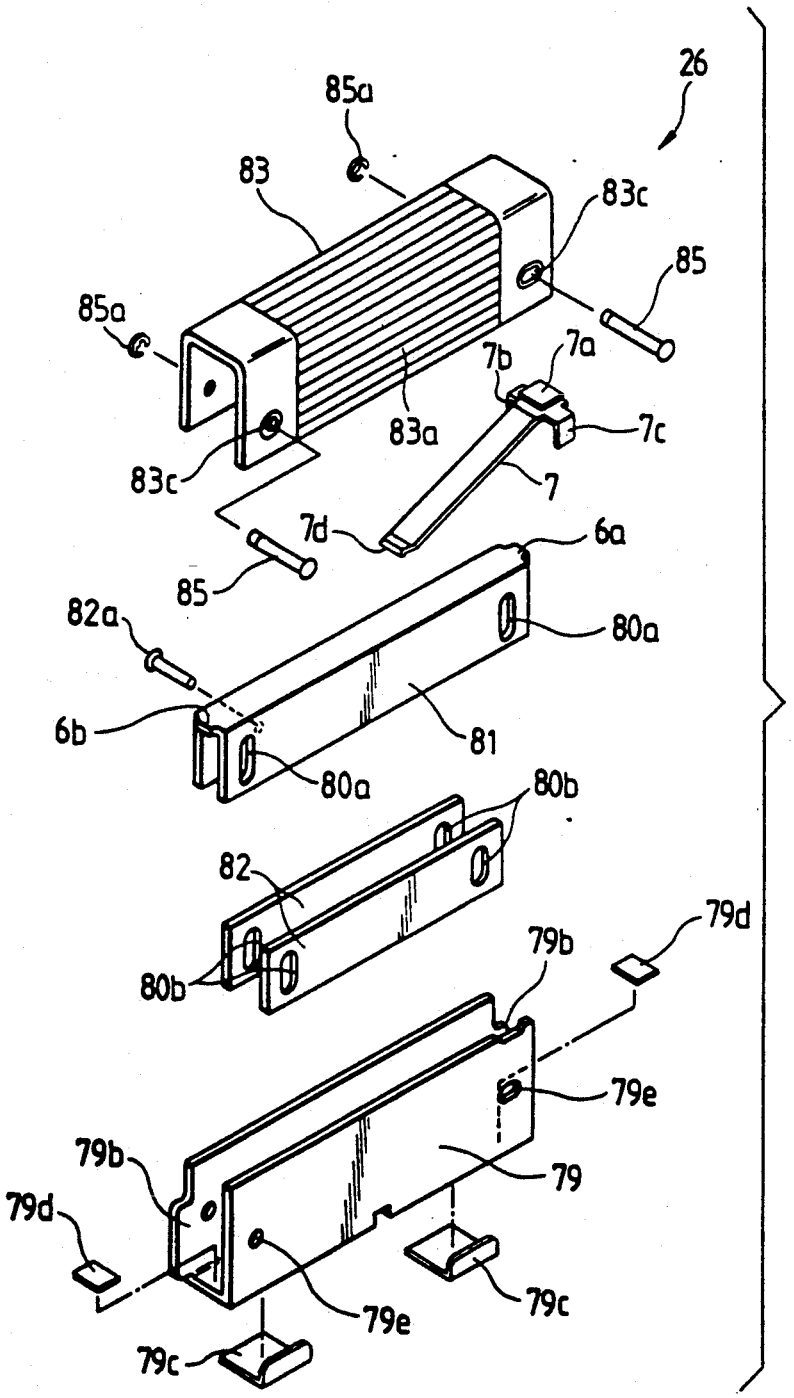

FIGS. 13 and 14 show weight (or urging means) 5 when there is no sheet S on stack support 15, while FIGS. 15 and 16 show the weight when there is a stack of sheets S.

Referring to FIGS. 13 to 17, biasing member 7 consisting of a leaf spring having channel-shaped stem 7*a* is provided between weight cover 83 and inner weight 6, with a folded upper portion of stem 7*a* urged against the back or inner surface of weight cover 83. Biasing member 7 has a pair of opposite side projections 7*b* and 7*c* projecting from its portion facing the folded portion. Stem 7*a* of biasing member 7 is supported with projections 7*b* and 7*c* urgedly held in notches 9*b* formed in upper portions of the inner surface of the side portions of outer weight 9. Biasing member 7 has arcuately curved feed end 7*d*, which urges a central portion of the inner surface of the top of inner weight 6.

When more than a certain number of sheets S are stacked on stack support 15 as shown in FIG. 15, projections 6*a* and 6*b* at the opposite ends of inner weight 6 are found above stoppers 46*a* and 47*a*. In this state, inner weight 6 is supported by bottom portion 9*a* of outer weight 9. In this state, any urging force applied to inner weight 6 by biasing member 7 does not become a force urging sheets S.

Thus, in this state, like weight 26 shown in FIGS. 9 and 10, the weight of the total components of weight 5 including outer weight 9, inner weight 6 and weight cover 83 is being applied as urging force to sheets S. When the number of sheets S on stack support 15 is reduced after the engagement of projections 6*a* and 6*b* of inner weight 6 with stoppers 46*a* and 47*a*, inner weight 6 is separated from bottom portion 9*a* of outer weight 9. This time, the distance h between the top of inner weight 6 and top of weight cover 83 is reduced progressively to cause progressive increase of the flexing of biasing member 7.

Figure 12:
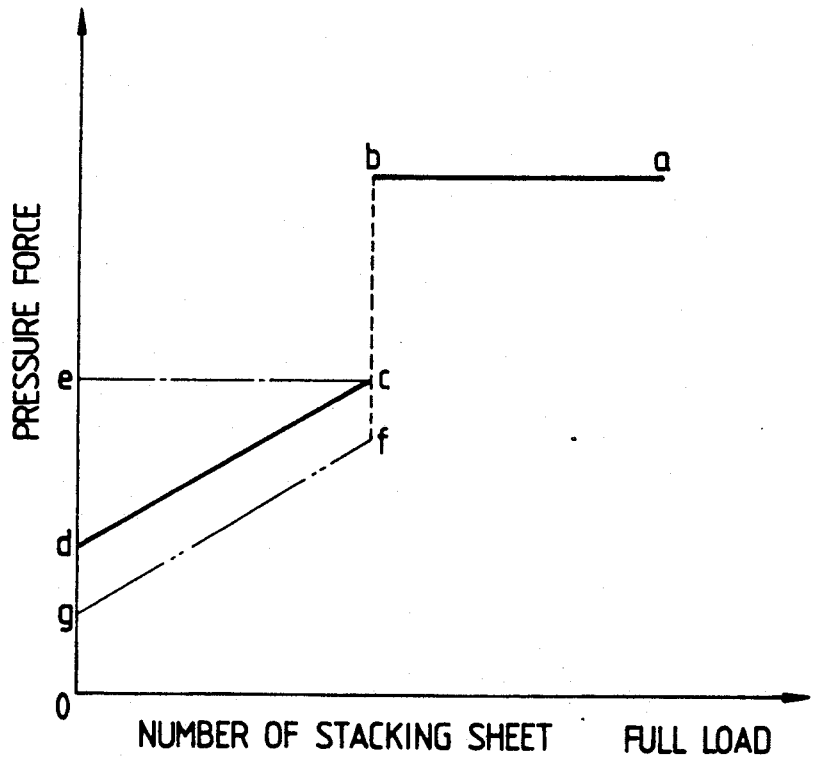
FIG. 12 is a graph showing a weight characteristic.

As a result, a weight is applied to sheets S, which is the weight of weight 5 minus the sum of the weights of inner weight 6 and auxiliary weights 82 and an acting force provided by the elasticity of biasing member 7. Since distance h is reduced with reducing number of stacked sheets S, the urging force of weight 5 applied to sheets S is reduced progressively as shown in FIG. 12. More specifically, the urging force of weight 5 is changed in the order of points a, b, c and d in FIG. 12, and the urging force when there is no stacked sheet is less than that in the prior art case.

In the above embodiment, the point of action of biasing member 7 on inner weight 6 is set to be substantially the center of the top of inner weight 6 in order to permit automatic adjustment of urging forces on the opposite sides of the point of action lest the opposite side urging forces should be different in case of envelopes having different opposite side swelling portions as sheets S.

Inner weight 5, outer weight 9 and biasing member 7 are made of an electrically conductive material and are held in contact with one another. By so doing, weight 5 can be perfectly grounded.

Figure 18:
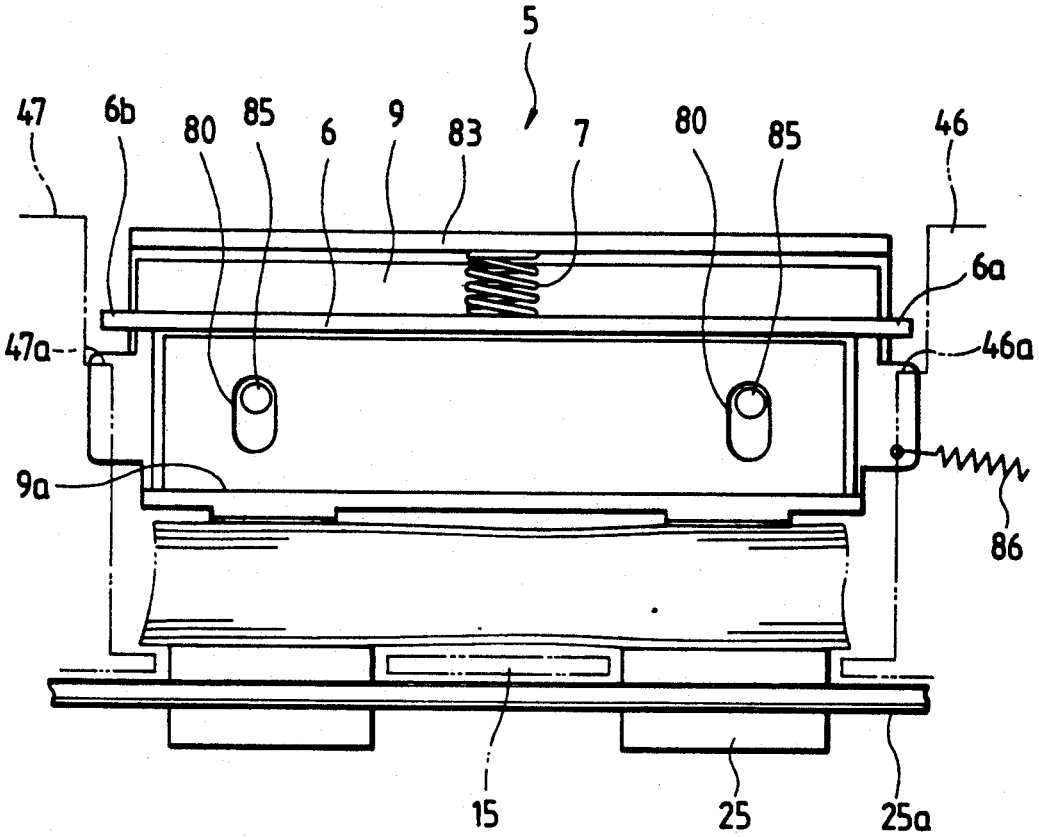
Figure 19:
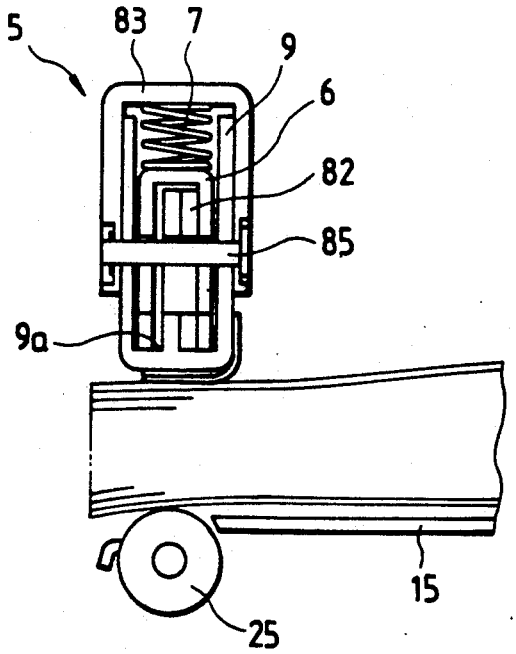

FIGS. 18 and 19 show a different example of urging means according to the invention.

Referring to the Figures, biasing member 7 provided between weight cover 83 and inner weight 6 of weight 5 is a compression coil spring, and the other structure is the same as that of weight 5 shown in FIGS. 13 and 14. With this example of weight 5, the same function and results as with weight 5 shown in FIG. 13 can be obtained when urging sheets S. While urging member 7 in this example and also that in the previous example of FIG. 13 are provided between weight cover 83 and inner weight 6, since weight cover 83 is made integral with outer weight 9 via pins 85, biasing member 7 equivalently intervenes between outer weight 9 and inner weight 6.

While in each of the above examples the action of weight 5 is changes stepwise in two stages, it is also possible to permit reduction of the urging force of weight 5 in three stages.

Further, while in the above cases the initial biasing force of biasing member 7 is zero as shown by points a, b, c and d in FIG. 12, it is of course possible to permit variation of the urging force as shown at points a, b, f and g by providing biasing member 7 with a suitable initial biasing force.

Further, it is possible to vary the weight applied to sheets S by varying the position of contact between projections 81*a* and stoppers 46*a* and 47*a* with variation of the thickness of buffering members 79*d*.

Figure 20:
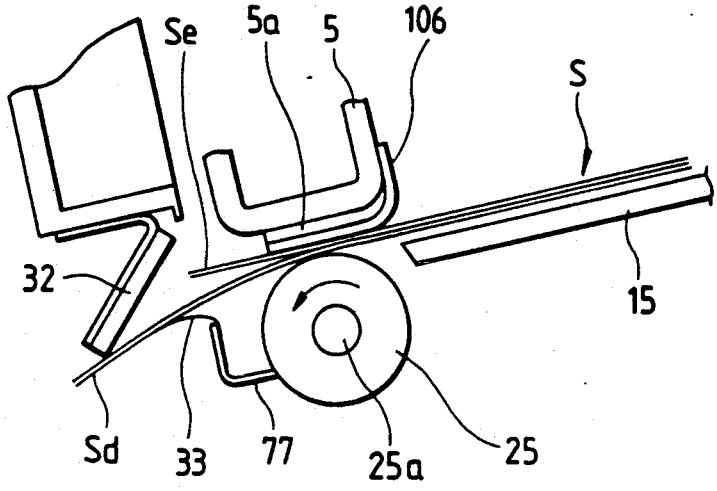
FIGS. 20 to 24 are views for explaining a friction member provided on weight.
Figure 21:
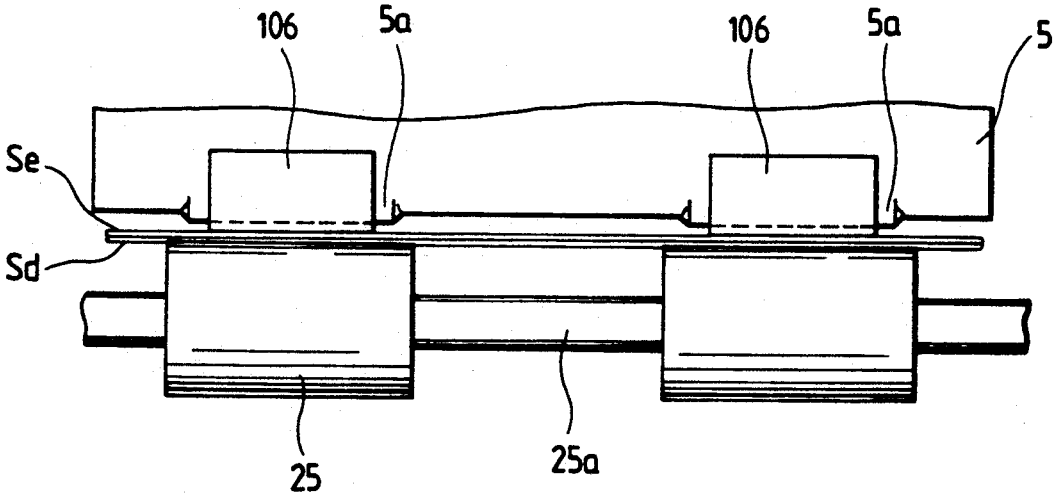

A further embodiment will now be described, in which the weight is provided with a friction member. As shown in FIGS. 20 and 21, the lower or outer surface of the bottom portion of weight 5 has a pair of urging surfaces 5*a* for urging sheets S. Urging surfaces 5*a* are provided with friction members 106 for preventing double feeding of sheets S. The materials of friction members 106 and feed roller 25 are selected such as to satisfy a relation $$\mu_3 < \mu_1 < \mu_2$$

where $\mu_1$ is the coefficient of friction of between friction members 106 and sheet S, $\mu_2$ is the coefficient of friction between feed roller 55 and sheet S, and $\mu_3$ is the coefficient of friction between adjacent sheets S.

Since the coefficient $\mu_1$ of friction between friction members 106 provided on urging surfaces 5*a* of weight 5 and sheet S is greater than the coefficient $\mu_3$ of friction between adjacent sheets S and less than the coefficient $\mu_2$ of friction between feed roller 25 and sheet S as noted above, when two sheets S remain on stack support 15, the feeding-out of the last sheet S from stack support 15 is prevented by the frictional force provided by friction members 106 of weight 5, and only the last but one sheet S (i.e., the lowermost sheet) is thus fed out by feed roller 55. It is thus possible to prevent double feeding of the last sheet along with the last but one sheet. In addition, since the frictional force provided by feed roller is greater than the frictional force provided by friction members 106, the last sheet can be fed out smoothly after completion of the feeding-out of the last but one sheet.

Figure 22:
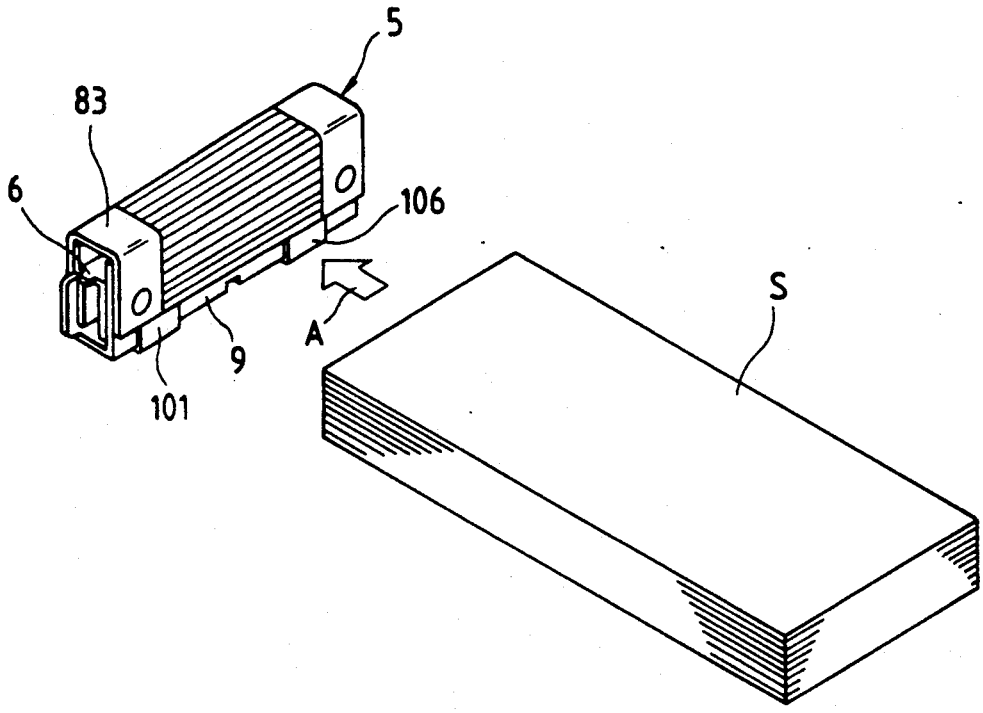

A further embodiment will be described with reference to FIG. 22. Referring to the FIG. 22, a pair of friction members 106 are applied to the bottom surface to a front upright surface in the sheet-feeding direction. Friction members 106 are made of a material having substantially the same coefficient of friction as that of sheets. They are covered by or located inwardly of weight cover 83. In this construction, the operator inserts sheet stack S in the direction of arrow A. At this time, even if the leading ends of sheets S strike weight 5, they will never touch end portions of friction members 106 covered by or located inwardly of weight cover 83. The operator aligns the leading ends of sheets S by bringing them into contact with end-restricting member 30. Also, the operator restricts movement of sheets S in the width direction thereof by displacing restricting members 16*a* and 16*b*. Further, the operator lowers weight 5 to urge sheets S against feed roller 25.

Figure 23:
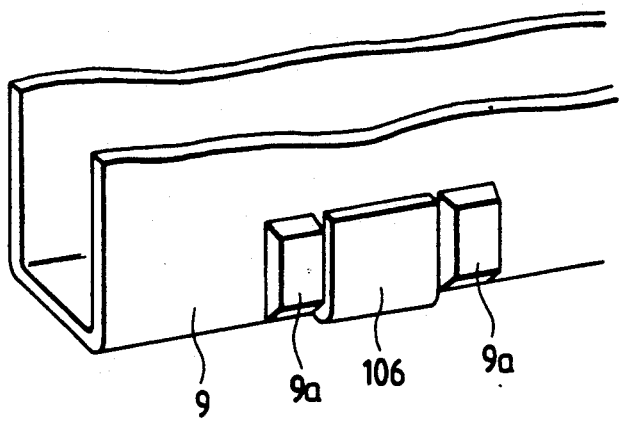
Figure 24:
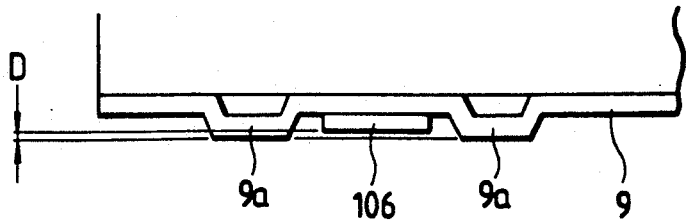

Further, as shown in FIGS. 23 and 24, on the front side of outer weight 9 low frictional coefficient projections 9*a* projecting from friction members 106 by slight distance D are provided on the opposite sides of friction members 106 or on outer weight 9. With this structure, when ends of sheets touch weight 5 while weight 5 is held raised for replenishment with sheets, they strike projections 9*a* and are smoothly guided downwardly of weight 5. It is thus possible to prevent sheet end portions from being bent or curled in contact with friction members 106 being raised.

A further embodiment will be described with reference to FIG. 25. Referring to the Figure, detecting lever 21 for detecting sheet S is pivoted by pin 22 to stack support 15, and its lower portion can be advanced into and retreated from and thus on-off operate photointerpreter 23 provided on the back surface of stack support 15. When there is no sheet S on stack support 15, an upper end portion of detecting lever 21 is turned upwardly with respect to stack support 15, thus indicating the absence of sheet S. Stack support 15 is provided with escapement 15*b* for avoiding interference of sheet-detecting means (21, 23) with detecting lever 21.

If detecting lever 21 is exposed without any sheet S on stack support 15, sheet-detecting means (21, 23) are liable to execute an erroneous operation or damaged.

Figure 25:
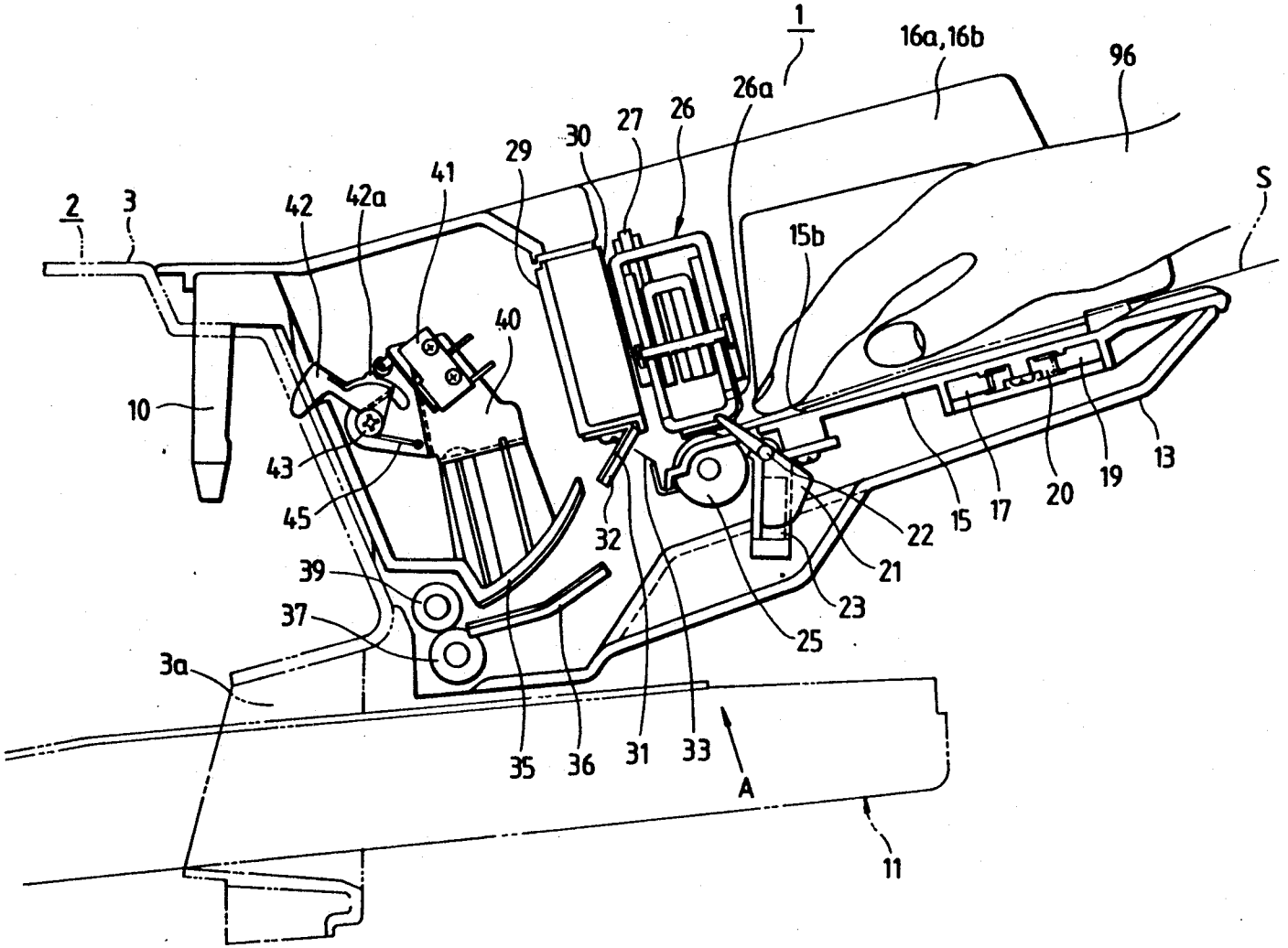
FIG. 25 is a sectional view illustrating the relation between weight and detecting lever.

With detecting lever 21 disposed beneath weight 26 as shown in FIG. 25, the user can with difficultly touch detecting lever even when there is no sheet S on stack support 15. Even if detecting lever 21 is touched, only its portion near the center of its rotation is touched.

As one goes toward the free end of detecting lever 21, the contact action is more delicate. That is, slightly touching a portion of detecting lever 21 near the rotational center thereof has no substantial adverse effects compared to the case of touching the free end of the lever. It is thus possible to prevent erroneous operation or damage to detecting lever 21 due to touching.

We claim:

1. A sheet feeding apparatus, comprising:

supporting means for supporting stacked sheets;

feeding means for applying a feeding force to a lowermost sheet of the stacked sheets;

urging means of double construction comprising a first urging member for urging the stacked sheets against said feeding means and a second urging member contained in said first urging member for urging the stacked sheets against the feeding means; and stopper means for releasing one of said urging members from urging against the stacked sheets when an amount of the stacked sheets is less than a predetermined value.

2. A sheet feeding apparatus according to claim 1, wherein said stopper means comprises a protrusion provided on one of said urging members and a stopper provided on a side plate of said sheet feeding apparatus, said protrusion engaging with said stopper when an amount of the stacked sheets equals the predetermined value, for releasing one of said urging members from urging against the stacked sheets.

3. The sheet feeding apparatus according to claim 1, wherein said urging means includes a friction member provided on a surface in contact with the stacked sheets, said friction member being in frictional contact with the sheet stacked sheets.

4. A sheet feeding apparatus according to claim 1, wherein said first urging member has a pair of parallel walls to contain said second urging member thereinto.

5. A sheet feeding apparatus according to claim 1, wherein each of said urging members urges the stacked sheets against said feeding means by its own gravity.

6. A sheet feeding apparatus according to claim 1, wherein said supporting means is slanted so that a side adjacent to said feeding means is located downwardly.

7. A sheet feeding apparatus, comprising:

supporting means for supporting stacked sheets;

feeding means for applying a feeding force to a lowermost sheet of the stacked sheets;

first and second urging means for urging the stacked sheets against said feeding means, wherein one of said first and second urging means is contained in the other of said first and second urging means;

stopper means for releasing one of said first and second urging means from urging against the stacked sheets when an amount of the stacked sheets is less than a predetermined value; and separating means arranged at a position downstream of said feeding means and inclined with respect to a sheet feeding direction, said separating means being adapted to separate the sheets one by one by cooperation of the feeding force of the sheet fed out from said feeding means and a friction force generated upon an abutment of a leading edge of the sheet fed out.

8. A sheet feeding apparatus according to claim 7, wherein each of said first and second urging means urges the stacked sheets by its own gravity.

9. A sheet feeding apparatus according to claim 7, wherein said supporting means is slanted so that a side adjacent to said feeding means is located downwardly.

10. A sheet feeding apparatus, comprising:

supporting means for supporting stacked sheets;

feeding means for applying a feeding force to a lowermost sheet of the stacked sheets;

urging means, including first and second urging members, for urging the stacked sheets against said feeding means;

stopper means for releasing only said first urging member from urging against the stacked sheets whenever an amount of the stacked sheets is less than a predetermined value; and spring means, provided between said first urging member and said second urging member, for biasing said second urging member in a direction reverse to the urging direction after said stopper means has released said first urging member.

11. An image forming apparatus, having:

supporting means for supporting stacked sheets;

feeding means for applying a feeding force to a lowermost sheet of the stacked sheets;

urging means of double construction comprising a first urging member for urging the stacked sheets against said feeding means and a second urging member contained in said first urging member for urging the stacked sheets against said feeding means;

a stopper means for releasing one of said first and second urging members from urging against the stacked sheets whenever an amount of the stacked sheets is less than a predetermined value; and image forming means for forming an image onto the sheet fed out by said feeding means.

12. An image forming apparatus, comprising:

supporting means for supporting stacked sheets;

feeding means for applying a feeding force to a lowermost sheet of the stacked sheets;

first and second urging means for urging the stacked sheets against said feeding means, wherein one of said first and second urging means is contained in the other of said first and second urging means;

stopper means for releasing one of said first and second urging means from urging against the stacked sheets when an amount of the stacked sheets is less than a predetermined value;

separating means arranged at a position downstream of said feeding means and inclined with respect to a sheet feeding direction, said separating means being adapted to separate the sheets one by one by cooperation of the feeding force of the sheet fed out from said feeding means and a friction force generated upon an abutment of a leading edge of the sheet fed out; and image forming means for forming an image onto the sheet fed out by said feeding means.

13. An image forming apparatus, comprising:

supporting means for supporting stacked sheets;

feeding means for applying a feeding force to a lowermost sheet of the stacked sheets;

urging means, including first and second urging members, for urging the stacked sheets against said feeding means;

stopper means for releasing only said first urging member from urging against the stacked sheets whenever an amount of the stacked sheets is less than a predetermined value;

spring means, provided between said first urging member and said second urging member, for biasing said second urging member in a direction reverse to the urging direction after said stopper means has released said first urging member; and image forming means for forming an image onto the sheet fed out by said feeding means.

* * * * *

UNITED STATES PATENT AND TRADEMARK OFFICE

CERTIFICATE OF CORRECTION

PATENT NO. : 5,230,503

DATED : July 27, 1993

INVENTOR(S) : JUN SAITO, ET AL.

It is certified that error appears in the above-indentified patent and that said Letters Patent is hereby corrected as shown below:

TITLE PAGE

[56] References Cited, "Kloeker" should read --Kroeker--.

COLUMN 8

Line 36, "is" (first occurrence) should be deleted.

COLUMN 10

Line 30, "sheet" should be deleted.

COLUMN 11

Line 25, "a" should be deleted.

Signed and Sealed this

Twenty-ninth Day of March, 1994

Bruce Lehman

*Attest:*

BRUCE LEHMAN

*Attesting Officer*

*Commissioner of Patents and Trademarks*